United States Patent [19]

Kanner et al.

[11] 4,228,343

[45] Oct. 14, 1980

[54] COLLAPSIBLE CORDLESS ELECTRIC HAIR CURLING APPLIANCE

[75] Inventors: Gary L. Kanner, Lebanon; Samuel H. Kohler, Lancaster; Robert E. Lewis, Peach Bottom, all of Pa.

[73] Assignee: Schick Incorporated, Westport, Conn.

[21] Appl. No.: 865,363

[22] Filed: Dec. 29, 1977

[51] Int. Cl.[2] ..... A45D 1/04; H05B 3/06; H01R 11/02

[52] U.S. Cl. ..... 219/225; 132/37 A; 219/230; 219/505; 219/533; 219/541; 338/23; 338/328; 339/8 R; 339/34; 339/58

[58] Field of Search ..... 219/222–227, 219/230, 240, 504, 505, 533, 541; 132/7, 9, 11 R, 31 R, 31 A, 32 R, 32 A, 32 B, 37 R, 37 A, 117, 118; 339/58, 8 R, 108 R, 34; 338/22 R, 23, 328

[56] References Cited

U.S. PATENT DOCUMENTS

| | | | |
|---|---|---|---|
| 491,313 | 2/1893 | Jenkins | 219/222 X |
| 532,066 | 1/1895 | Howard et al. | 132/37 A |
| 996,821 | 7/1911 | Wulff | 132/37 A |
| 1,090,238 | 3/1914 | Schwartz | 219/533 |
| 1,768,260 | 6/1930 | Larkey | 339/58 X |
| 2,056,951 | 10/1936 | Bohall et al. | 219/236 |
| 2,606,986 | 8/1952 | Sweger | 338/23 X |
| 3,124,404 | 3/1964 | Chesmov | 339/34 |
| 3,458,794 | 7/1969 | Bohnstedt et al. | 320/2 |
| 3,569,909 | 3/1971 | Hara | 339/34 X |
| 3,859,497 | 1/1975 | McNair | 219/225 |
| 3,926,494 | 12/1975 | Maillaro | 339/34 |
| 3,955,064 | 5/1976 | Demetrio | 219/225 |
| 3,996,447 | 12/1976 | Bouffard et al. | 219/505 X |
| 4,040,696 | 8/1977 | Wada et al. | 339/8 R |
| 4,075,458 | 2/1978 | Moyer | 219/225 |
| 4,097,718 | 6/1978 | Weise | 219/225 X |
| 4,101,757 | 7/1978 | Van Dyck et al. | 219/230 X |
| 4,147,927 | 4/1979 | Pirotte | 219/541 |
| 4,239,972 | 3/1890 | Walbridge et al. | 132/37 R |

FOREIGN PATENT DOCUMENTS

| | | | |
|---|---|---|---|
| 2307430 | 11/1976 | France | 219/504 |
| 1375768 | 11/1974 | United Kingdom | 219/225 |

*Primary Examiner*—A. Bartis

*Attorney, Agent, or Firm*—Lockwood, Dewey, Alex & Cummings

[57] ABSTRACT

A collapsible cordless electric hair curling appliance includes a hollow handle adapted for grasping by a user. A heating wand is extensibly slidably retained in the hollow portion of the handle. An improved positive temperature coefficient heating element assembly is positioned inside the wand. An electric plug assembly is also slidably mounted in the hollow portion of the handle. The plug is mounted so as to extend from the handle for connection with a conventional electric socket only when the wand is substantially fully inserted into the hollow handle. The novel plug assembly eliminates the need for a conventional electric cord and is also rotatably mounted in the handle to provide added convenience for plugging the appliance into a conventional electric socket. For storage, both the wand and plug assembly may be enclosed within the handle. The electric circuit for heating the wand is closed only when both the wand is fully inserted in the handle and the plug assembly is fully extended therefrom to provide added safety features to the appliance.

23 Claims, 20 Drawing Figures

23
31
21
20
25
24
22
32

5
23
21
30
20
30a
25
22
24
32
5

6
21
30
20
30a
25
27
24
26
28
22
32
6

21
27
24
30
23
20
25

COLLAPSIBLE CORDLESS ELECTRIC HAIR CURLING APPLIANCE

BACKGROUND OF THE INVENTION

The present invention relates generally to hair curling appliances, and more particularly, to a portable hair curling appliance which provides improved operating convenience along with added safety features while being economical to manufacture.

Differing types of hair curling appliances have long been used for imparting curls to hair. Conventional curling appliances generally include a curling iron or wand which is heated in some manner. Hair is then wrapped around the heated portion to impart a curling effect. The curling irons or wands associated with these appliances have heretofore been either internally or externally heated. In the internally heated type, a heating element, which is generally electrically powered, is situated in the working portion of the wand to heat the hair as it is looped or wound therearound. In the externally heated type, the wand is formed of a material having a high heat coefficient, and is inserted into or positioned contiguous with a heating element positioned in a base external to the wand to transfer heat from the element to the wand to prepare it for use in curling hair.

Each of these two types of hair curling appliances has advantages and disadvantages with respect to the other type. The internally heated type maintains its heat for long periods of time. However, the electric cord and connection required to power such an appliance provides an inconvenience for the user. While the externally heated type curling iron has no electric cord or connection, once the appliance is withdrawn from its heated base, the wand begins to lose heat and is usable for shorter periods of time than the internally heated type.

Internally heated types of hair curling appliances have recently been introduced wherein an electric cord has been eliminated. This appliance includes a wand portion which is extensible from the handle. When the wand is extended fully outwardly of the handle, an electric plug is pivotally moved to an external position. The curling appliance may then be inserted in an electric outlet until the wand portion is sufficiently heated for use. Prior to using the wand, the plug is pivotally returned to its position inside the handle, thus opening any electric circuit in the appliance.

This newer type of hair curling appliance also has several disadvantages. First, since the heating element extends outwardly of the handle while its electric circuit is closed, there may be a temptation for a user to grasp the hot part of the wand while removing the appliance from an electric outlet. Further, when the electric plug is swung outwardly of the handle, the appliance can be plugged into a conventional outlet in only one position. The lack of variable mounting positions may lead to user inconvenience. A need has developed for a compact curling appliance which overcomes these deficiencies while being inexpensive to manufacture. Such a hair curling appliance should provide ease of manipulation by a user during hair curling operations with improved convenience and safety.

Accordingly, it is a general object of the present invention to provide a new and improved hair curling appliance.

It is another object of the invention to provide a collapsible portable hair curling appliance which provides improved protection from the heatable portion thereof for both users or other persons and clothing accessories.

It is another object of the present invention to provide a new and improved portable hair curling appliance of the internally heated type which can be more economically produced than heretofore known hair curling appliances of that type.

SUMMARY OF THE INVENTION

The invention is directed to a hair curling appliance comprising a hollow handle which is adapted for convenient grasping by the hand of a user. A curling wand including a heat retaining working portion is slidably mounted in the hollow interior of the handle for user-operated movement outwardly and inwardly thereof. An electric plug assembly is slidably retained in the handle and is extensible therefrom for conductively engaging a conventional wall socket. When the plug assembly is in its extended position, the operating circuit is closed to connect the plug with the working portion of the wand. The slidable movement of the wand in the handle provides cooperative engagement with the plug assembly to extend same therefrom only when the wand is substantially fully inserted therein.

The invention is further directed in a hair curling appliance of the type described above to a novel electric plug assembly which is both rotatably and extensibly mounted in the hollow portion of the appliance handle, therefore eliminating the need for a conventional electric cord.

The invention is further directed to an improved positive temperature coefficient heating element assembly for a hair curling appliance.

The invention is further directed in a hair curling appliance of the type described above wherein both the wand and electric plug assembly may be simultaneously retained inside the handle for storage or traveling purposes.

BRIEF DESCRIPTION OF THE DRAWINGS

The features of the present invention, which are believed to be novel, are set forth with particularity in the appended claims. The invention may best be understood from the following detailed description of a currently preferred embodiment thereof, taken in conjunction with the accompanying drawings, wherein:

DETAILED DESCRIPTION OF THE PREFERRED EMBODIMENT

Referring to FIGS. 1-4, the hair curling appliance of the present invention 20 includes an aesthetically pleasing hollow portion or handle 21, a curling iron or wand 22 which is extensible from the front of the handle 21, and a rotatably mounted male electric plug assembly 23, which is selectably extensible from the handle 21 adjacent the rear thereof.

Figures 1, 2, 3, 4:
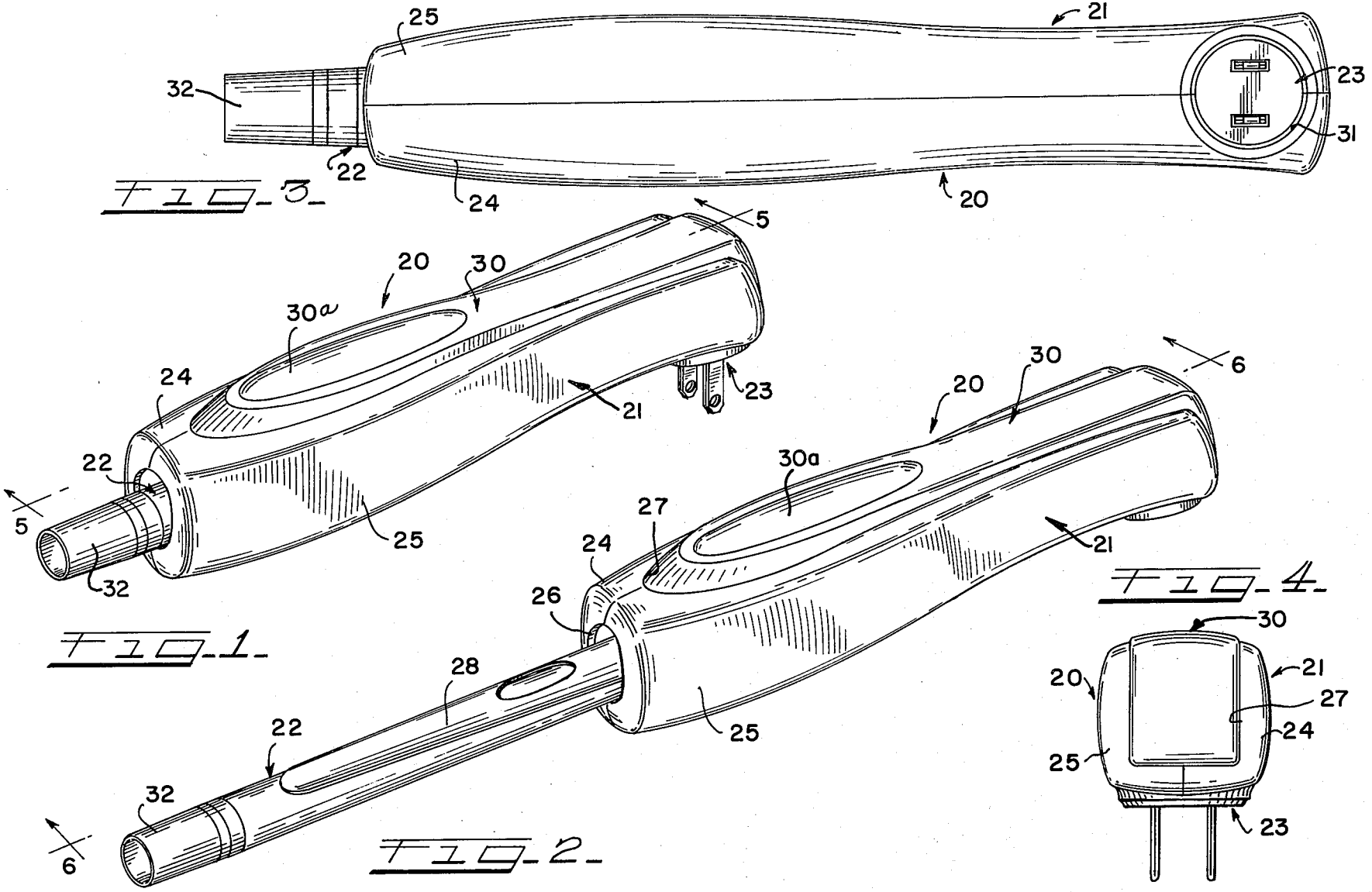
FIG. 1 is a perspective view of the hair curling appliance of the invention shown in its collapsed condition preparatory to being plugged into a conventional electrical outlet.
FIG. 2 is a perspective view of the hair curling appliance of FIG. 1 showing the curling wand in extended position.
FIG. 3 is a bottom plan view of the hair curling appliance of FIG. 1.
FIG. 4 is an end elevational view of the hair curling appliance of FIG. 1.

The hollow handle 21 is preferably made of impact resistant plastic and, in this embodiment, includes two opposing half-shell members 24, 25 which butt together along the center of the handle. The interlocking half-shell members may be fastened together by sonic welding, adhesive bonding, or other conventional fastening means. When the two half-shell members 24, 25 are fastened together, they define three apertures in the outer surface of the handle. At the front of the handle, an elongate aperture 26 is formed symetric with the parting line between the half-shells. The wand 22 extends through the first handle aperture 26. A second elongate aperture 27 extends along the top of handle 21 and substantially down the rear side of the handle (FIG. 4). A spring biased user-movable actuator 30 is mounted in aperture 27 and will be discussed further below. A circular bottom aperture 31 (FIG. 3) provides a mounting for the rotatable and extensible electric plug assembly 23.

It should be noted that the handle 21 is aesthetically shaped for user convenience. The thumb of a user is intended to be positioned on the oval portion 30*a* of actuator 30 and the forefinger and adjacent fingers are adapted to be positioned around the widest portion of the handle. The index finger is adapted to be positioned around a narrower portion of the handle 21 as the handle tapers from the front towards the rear of the handle. It can be appreciated that while the actuator 30 may be manipulated by the user's thumb, it may also be user-manipulated by the tips of the user's fingers, if desired, and the curling iron 20 provides ease of use in almost any rotational position.

The extensible wand 22 includes, besides the heating element itself, an insulated plastic end tip 32 which may be grasped by a user when the heating element is hot in order to allow the wand to be extended from or inserted into the handle 21. Wand 22 further includes a pivotally mounted hair clamp member 28 which biases loose ends of hair to the wand. The pivotal movement of clamp member 28 is operated by depressing the oval portion 30*a* of actuator 30, and will be discussed in more detail below.

Referring to FIGS. 5-8, the hollow interior of handle 21 houses the wand 22, the electric plug assembly 23, and a novel mechanism for providing cooperative movement therebetween. The mechanism does not allow both the electric plug 23 and the wand 22 to extend from handle 21 at the same time. Therefore, when the appliance is plugged into a conventional electric outlet, the wand 22 will be safely positioned inside handle 21 so that a user or a child will not be tempted to grasp a hot wand. It should be noted that the handle 21 is made of a heat insulating plastic which maintains its outer surface substantially cooler than the wand surface.

The mechanism which provides the coaction of movement between the wand 22 and the electric plug assembly 23 may best be particularized after the respective wand and plug are described. Referring to FIGS. 6, 12, 13, and 14, the novel electric plug assembly 23 comprises a pair of conventional electric prongs 33-33 which are embedded in a circular base 34. The top surface of circular base 34 (FIG. 14) includes two electrical contacts, the first being a circular central contact 35 and the second being an annular contact 36 positioned in spaced relation radially outwardly of first contact 35. The respective contacts 35 and 36 are each conductively connected to one of the respective prongs 33-33. The circular base 34 is rotatably received and retained in the bottom of a plug assembly housing 37. The base receiving portion of plug assembly housing 37 includes a plurality of downwardly extending resilient tongue members 40 which maintain the plug base therein by slidably retaining a detent portion thereof in a groove 41 which extends around the plug base. When the plug base is inserted in the plug assembly housing 37, a pair of circular contacts 42, 43 mounted in the bottom of the housing 37 engage the center contact 35 and annular contact 36 respectively on the plug base 34. Plug assembly housing 37 further includes an additional pair of electric contacts 44, 45 which are conductively connected to circular contacts 42, 43, respectively. Contacts 44 and 45 extend outwardly of the housing toward the interior of handle 21 as the housing 37 is mounted therein.

Figure 12:
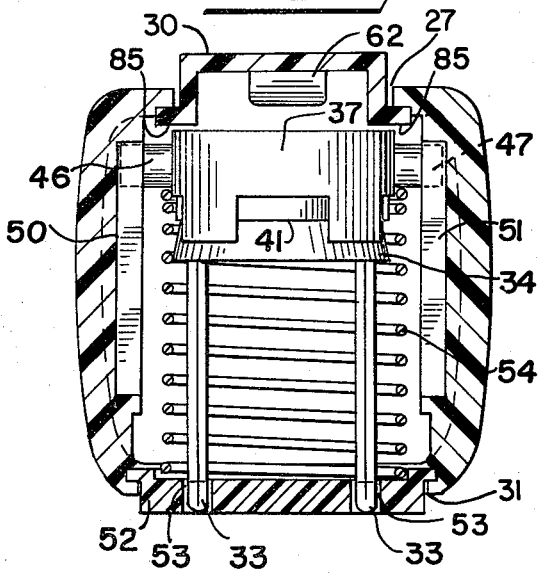
FIG. 12 is a cross-sectional view taken along line 12—12 of FIG. 6.

An important aspect of the present invention is the novel mounting of plug assembly 23 in the handle 21 such that the plug prongs 33-33 are biased toward the interior of handle 21, but are selectively extensible therefrom for inserting the plug in a conventional electric socket (not shown). The extensible biased mounting of plug assembly 23 in the hollow interior of handle 21, which is shown most clearly in FIG. 12, is accomplished by a pair of opposed bosses 46, 47 on housing 37 which are slidably retained in opposed vertically oriented indent slots 50, 51, each positioned on the interior surface of one of the half-shells 24, 25, respectively. Plug assembly 23 further includes a circular disc 52 which is rotatably retained in annular tongue and groove relation in the handle circular aperture 31. Disc 52 includes a pair of spaced slots 53-53 through which the plug prongs 33-33 are extensible. The plug base 34 and plug assembly housing 37 are maintained in an upward enclosed position inside handle 21 by means of a coil spring 54 which is positioned around the plug prongs 33-33 so as to engage the rotatable disc 52 at one end and the plug housing bosses 46, 47 at the other end thereof.

Figures 5, 6, 7, 13, 14:
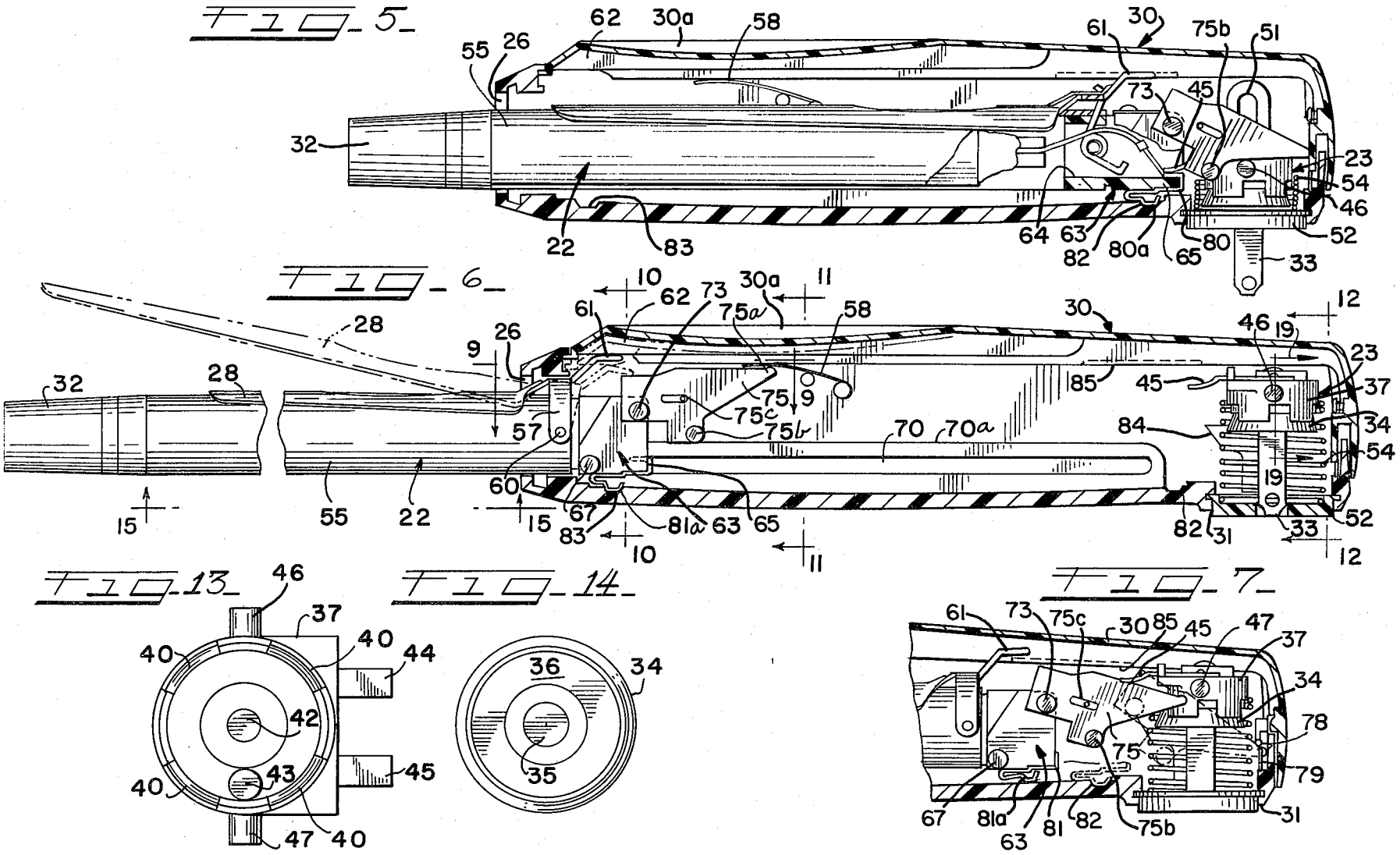
FIG. 5 is a cross-sectional view taken along lines 5—5 of FIG. 1.
FIG. 6 is a cross-sectional view taken along lines 6—6 of FIG. 2.
FIG. 7 is a partial sectional view of the hair curling appliance similar to that shown in FIG. 6 wherein the curling iron is collapsed into the handle without moving the electric plug positioned therein.
FIG. 13 is a bottom elevational view of the electric plug housing shown in FIG. 12.
FIG. 14 is a top elevational view of the rotatable plug base shown in FIG. 12.
Figure 10:
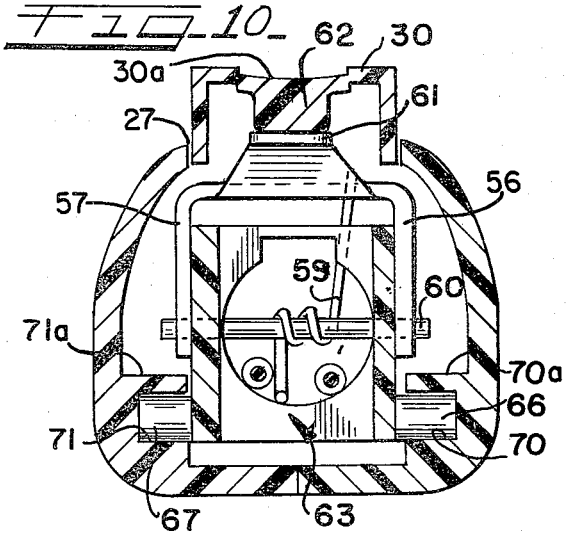
FIG. 10 is a cross-sectional view taken along line 10—10 of FIG. 6.

Referring to FIGS. 5, 6, and 10, the wand 22, as previously described, includes a plastic tip 32 at the distal end thereof and a clamp member 28 which is pivotally mounted to the wand adjacent the inner end thereof. Wand 22 further includes a hollow cylindrical element cover 55, which is preferably made of a high-heat conductive material such as aluminum. The heating element which is positioned inside the hollow tubular member 55 will be discussed separately below. Clamp member 28 includes downwardly extending opposed arm members 56, 57, and each arm includes a distal aperture at the end thereof which pivotally mounts upon an axle 60. The axle 60 extends diametrically through the heating element cover 55.

Figure 9:
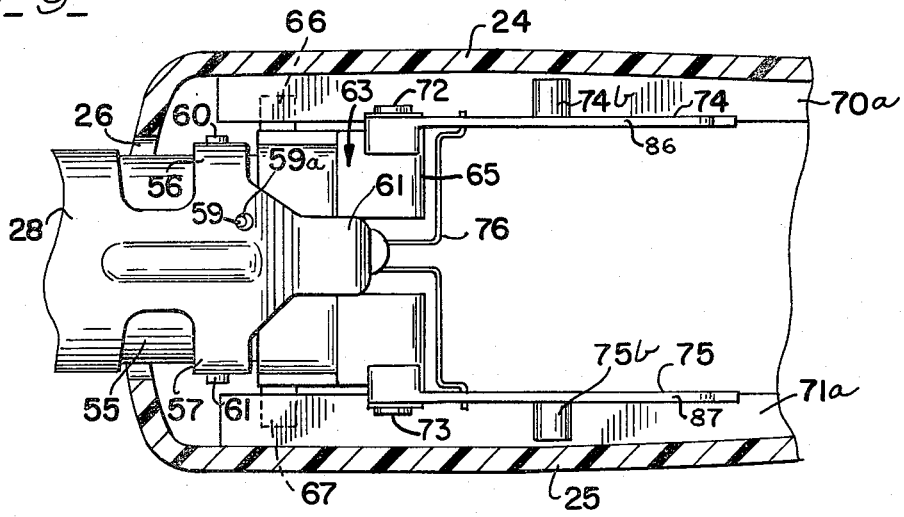
FIG. 9 is an enlarged partial sectional view taken along lines 9—9 of FIG. 6.

As shown most clearly in FIGS. 6, 9, and 10, an upwardly extending lever or tab 61 at the rear of clamp 28 is engageable with the front end of the spring biased actuator 30, and more specifically a downwardly extending web 62 positioned on the interior of the front portion thereof. Actuator 30 is biased upwardly at its front end by a pair of springs 58-58 (only one shown in FIG. 6), each fastened at one end thereof to the inner side surface of one of the handle half-shells 24, 25. When the heating element 22 is pulled outwardly of the handle 21 into its forwardmost position, the web 62 engages the tab 61. Then, when the front of the actuator 30 is pressed downwardly, clamp 28 is pivoted away from the wand cover 55. The clamp 28 is biased in its downward position by spring 59 (FIG. 10) which is positioned through an aperture **59*a* (FIG. 9) in the clamp, and wound around the axle 60 several times with the opposing end of spring 59 biased against the bottom wall of hollow heating element housing cover 55**.

Referring to FIGS. 5 and 6, the innermost portion of wand 22 includes a hollow adapter 63 extending outwardly of heating element cover 55 and securing the wand 22 in slidable movable relation inside handle 21. Adapter 63 is hollow and includes a generally annular front portion 64 (FIG. 5) and a generally rectangular rear portion 65. The axle 60, previously described in connection with the pivotal mounting clamp 28, also fixedly retains the adapter 63 in the end of wand 22 by being passed through diametrically opposed apertures therein.

The rectangular rear portion 65 of adapter 63 includes a pair of opposed cylindrical bearing surfaces 66, 67 extending outwardly from the vertical sides thereof. Cylindrical bearing surfaces 66, 67 are slidably retained in opposed slots 70, 71 which extend horizontally through the interior of each respective handle half-shell 24, 25, as is most clearly shown in FIG. 6. The position of the forward and rear ends of each respective slot 70, 71 determine the distance of horizontal travel which the wand 22 traverses as it is pulled outwardly of or pushed into the handle 21.

As shown most clearly in FIGS. 5, 6, 7, and 8, the cooperative movement between the wand 22 and the electric plug assembly 23 is an important aspect of the invention and is governed by contact between the bosses 46, 47 of the plug assembly housing 37 and an opposed pair of levers 74, 75 which extend rearwardly of the heating element adapter 63 in pivotal and biased relation thereto around mountings 72 and 73. As shown in FIG. 6, with the electric plug assembly 23 in its upward enclosed position and the wand 22 in its extended position, the rearwardly extending levers 74, 75 do not contact the bosses 46, 47. Further, a spring member 76 is secured at its base or light to the top of the adapter 63 while the opposed distal ends thereof connect to the respective levers 74, 75 through apertures **74*c*, 75*c* therein to upwardly bias said levers. As the wand is pushed into the hollow interior of the handle 21 by a user, the spring 76 and the bearing surfaces 74*b*, 75*b*, which ride on horizontal surfaces 70*a*, 71*a*, in the respective half-shells 24, 25, maintain the distal ends 74*a*, 75*a* of the respective levers in an upwardly biased position. Thereafter, when the wand 22 is positioned substantially fully rearward, the distal ends 74*a*, 75*a* of the levers engage the tops of the plug bosses 46, 47**, respectively.

Figure 8:
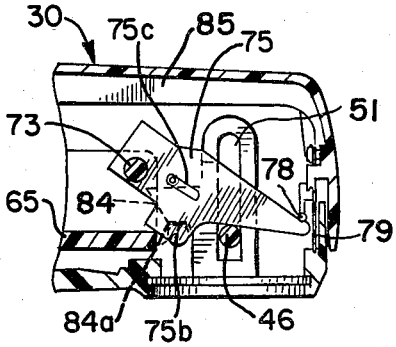
FIG. 8 is a partial cross-sectional view similar to FIG. 5 showing the controlled coordinated movement between the collapsible wand and the extensible electric plug.

When the levers are in a position to contact the respective plug bosses, the restraining surfaces **70.*a*, 71*a* of the interior slots in the respective handle half-shells end such that the levers are free for a short distance of travel to pivot around mountings 72, 73 by overcoming the upward biasing of spring 76. As the wand 22 is pushed farther into handle 21, the bearing surfaces 74*b*, 75*b* are pushed rearwardly so as to each engage an acutely angled cam surface 84-84 (only one of two being shown) positioned on the interior of each half-shell 24, 25, respectively. Cam surface 84-84, as most clearly shown in FIG. 8, is positioned forward of vertical electric plug retaining slots 50, 51, respectively. As the bearing surfaces 74*b*, 75*b* engage the acutely angled cam surfaces 84, the pivotally mounted levers 74, 75 are forced first in a downward movement such that the distal ends of levers 74, 75 push the electric plug housing 37 downwardly in its slidable mounting until the electric prongs 33-33 extend fully outwardly of the rotatable disc 52. Next, as the levers achieve their full downward position, bearing surfaces 74*b* and 75*b* are moved rearwardly along a horizontal portion 84*a* of each cam until the distal end 74*a*, 75*a* of each lever engages a locking post 78 (only one of two being shown) which extends inwardly of the rear end on each handle half-shell. The prongs 33-33** are thereafter locked in an external position facilitating their insertion in an electric socket.

With the wand 22 inside of handle 21 and the electric prongs 33-33 fully extended outwardly thereof, the curling iron is in a position to be energized electrically to heat the wand 22 to a desired temperature. When a user withdraws the wand 22 from the handle 21, by pulling on the insulated plastic tip 32 thereof, the rearwardly extending levers 74, 75 are moved away from the electric plug bosses 46, 47 and the coil spring 54 in the plug assembly biases the housing 37 upwardly to draw the electric prongs 33-33 into the interior of the handle.

Figure 11:
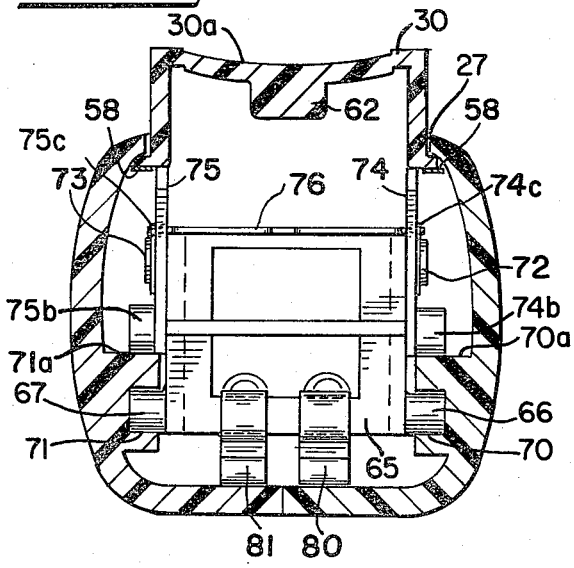
FIG. 11 is a cross-sectional view taken along lines 11—11 of FIG. 6.

As shown most clearly in FIGS. 5 and 11, the adapter 63 further includes a pair of electric contact clip members 80, 81 which are fastened to the bottom wall at the rear thereof. Clips 80, 81 include a distal back-folded spring portion 80*a*, 81*a*, which is biased so as to engage the front and rear indented slots 82, 83 in the bottom of the interior surface of handle 21. As shown in FIG. 5, the forwardly extending contacts 44, 45 of the plug assembly housing 37 are positioned to contact the topmost portion of the respective contact clips 80, 81 only when the plug assembly 23 is in its downwardmost position in handle 21. The engagement between contacts 44, 45 and clips 80, 81, respectively is accomplished by a wiping action which maintains the cleanliness of the contacts and assures electrical continuity therebetween. At that downwardmost position, the electric prongs 33-33 extend fully outwardly of the handle 21 and may be inserted in a conventional electric socket. With this novel assembly, the electric circuit in the appliance is closed and operable only when the wand 22 is fully inserted in handle 21 and the prongs 33-33 engage an electric outlet.

The cooperative movement between the wand 22 and the electric plug assembly 23 is controlled by the relative movement of the wand 22 in and out of the handle 21. When the wand 22 is fully inserted inside handle 21, plug assembly 23 may be selectively pushed downwardly in its biased reciprocal mounting such that prongs 33-33 extend substantially outwardly of handle 21 so as to provide a conductive contact with a conventional electric socket. Alternatively, the wand 22 may be fully inserted in handle 21 with the electric prongs 33-33 remaining in a withdrawn state inside the handle. The mechanism for producing the alternative movement will be discussed below in detail. Whenever the wand 22 is withdrawn or pulled outwardly of the handle 21, the electric plug assembly is always biased by spring 54 in an upward or internal position to assure that no electric current can be present in the appliance while it is being used. Further, with the plug assembly in its upward or internal position, any electrically conductive engagement with the heating element is broken.

Referring to FIG. 7, the wand 22 and plug assembly 23 may simultaneously be positioned inside the handle 21 for storage purposes. The rear portion of actuator 30 is biased upwardly by a spring wire 79 mounted thereon which slidingly engages a stop member on each body half-shell. Opposed flat horizontal surfaces 85-85 on the actuator 30 are positioned to engage the top surfaces 86, 87 of the respective levers 74, 75 before the distal ends thereof engage the bosses 46, 47 on the electric plug assembly 23. By depressing the rear of the actuator, surfaces 85-85 push the respective levers 74, 75 downwardly beyond the point where they would engage the electric plug bosses. Then, the wand 22 may be inserted fully within handle 21 without moving the electric plug assembly 23 from its internal position. When the wand 22 is drawn outwardly of the handle 21, the levers 74, 75 are automatically reset to their upward biased position for further cooperative movement therebetween as desired.

Another important aspect of the present invention may be described in connection with FIGS. 15–18, wherein the working portion of the wand 22 includes a PTC (positive temperature coefficient) heater, generally indicated at 90, which is securely mounted in the interior of hollow cover 55. A PTC heater utilizes a material, usually doped barium titanate, which exhibits increasing resistance with increasing temperature. When such a material is utilized for a PTC heater, it may be pre-engineered to possess an extremely sharp resistance increase at a desired temperature. Therefore, when the material is used in low wattage heaters, for example, it has a self-limiting temperature capability. Such a self-limiting heater is safer than prior-known heating elements and, at times, the heating element itself may not need a thermostat or other safety cut-off device. Heretofore, the PTC elements have normally been coated with nickel or silver on two opposed surfaces thereof for providing an electrical contact thereto. Also, prior art PTC heaters have included a plurality of PTC elements.

Figure 15:
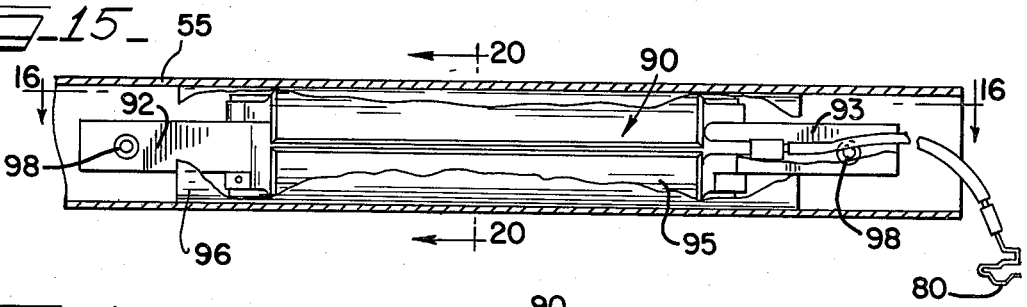
FIG. 15 is an enlarged cross-sectional view of the wand shown in FIG. 6 which is taken along line 15—15 of that figure.
Figure 16:
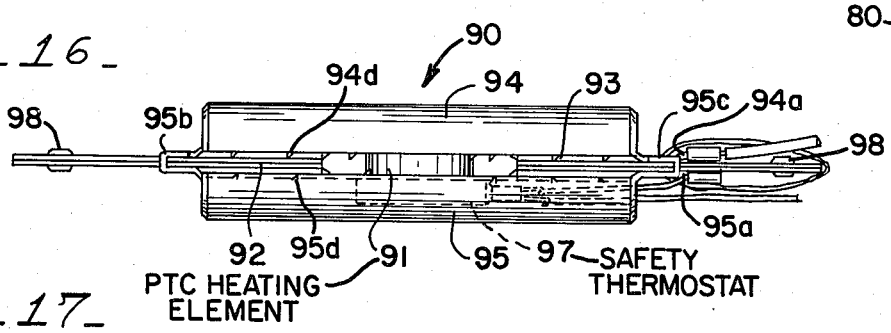
FIG. 16 is a top plan view of the wand heating element taken along line 16—16 of FIG. 15.
Figure 17:
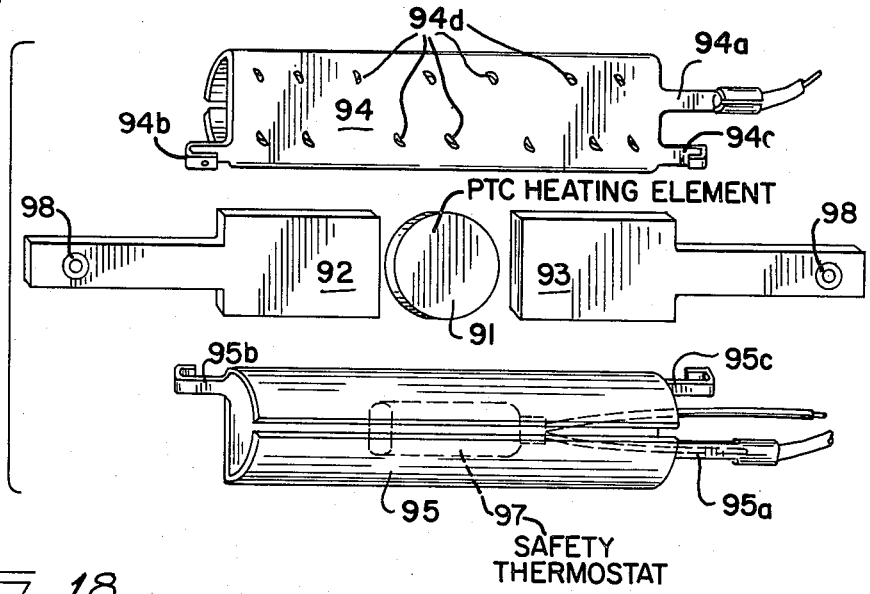
FIG. 17 is an exploded view of the wand heating element shown in FIGS. 15 and 16.

Applicant's PTC heater, as is shown most clearly in FIG. 17, includes one PTC element 91, two insulating pieces 92, 93 positioned in axially opposed relation on either side of the PTC element 91, and two opposed pressure plates 94, 95 which also function as contact plates to provide electric current to the PTC element 91. An electrically insulating film 96 extends around the plates 94, 95. The contact or pressure plates 94, 95 are semi-cylindrical in shape and each include electric contact portions 94*a*, 95*a* respectively, which, as shown in FIG. 15, are connected by wires to the respective contact clips 80, 81. Further, each contact plate includes bent tabular portions 94*b*, 94*c*, 95*b*, 95*c*, respectively, which are capable of retaining the insulating members 92, 93 sandwiched between the flat interior surface of the contact plates. A plurality of detent portions 94*d*-94*d*, 95*d*-95*d* secure the PTC element 91 and the insulating members 92, 93 between the contact plates 94, 95. As shown most clearly in FIGS. 15 and 16, the PTC heater 90 forms a compact cylindrical heating element when assembled. The heating element is capable of being inserted in the hollow interior of wand 22 under the aluminum cover 55. Further, the insulating members 92, 93 include end means 98 positioned at their distal ends for mounting the heating element 90 within the hollow cylindrical cover 55.

The voltage developed between contact plates 94 and 95 provides the force which heats the PTC element 91 to the desired temperature. The drastic increase in the resistance of the PTC element at that desired temperature prevents the element from overheating as the current decreases when the resistance rises.

Figure 18:
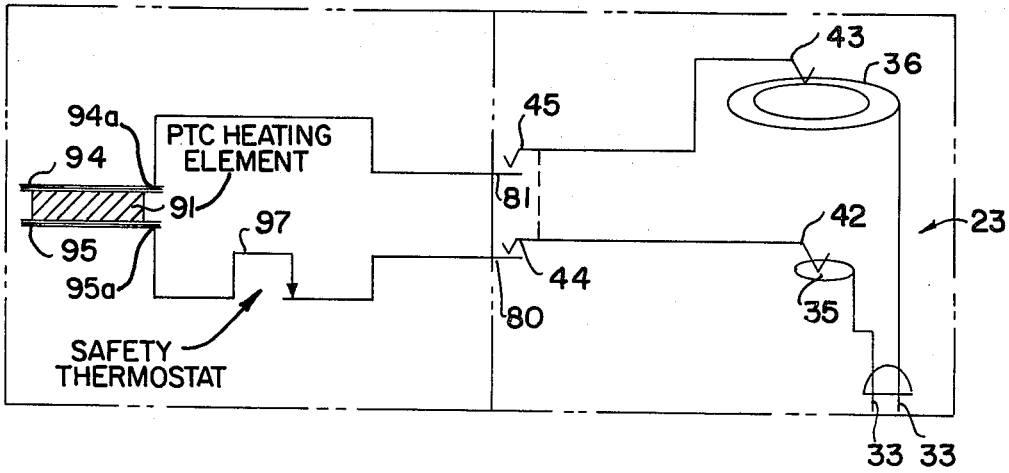
FIG. 18 is a schematic diagram of the electric circuit for the hair curling appliance of the present invention.
Figure 19:
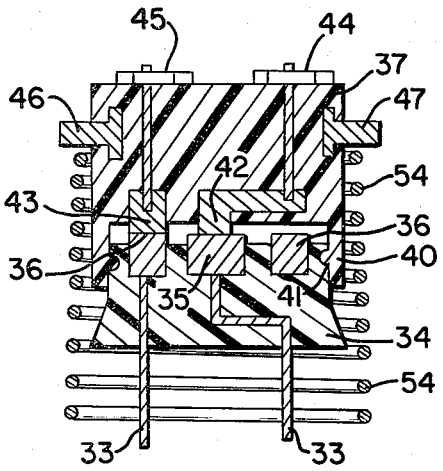
FIG. 19 is an enlarged cross-sectional view of the electric plug assembly taken along line 19—19 of FIG. 6.
Figure 20:
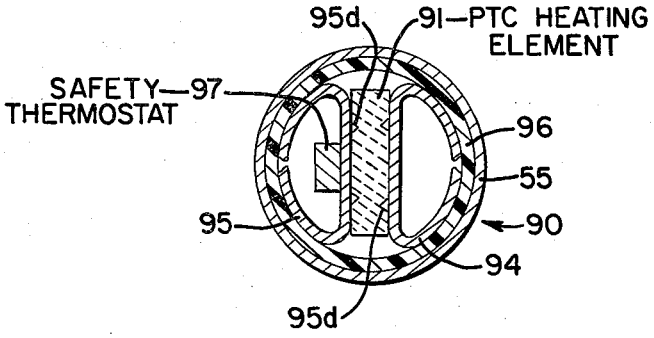
FIG. 20 is an enlarged cross-sectional view of the wand heating element taken along line 20—20 of FIG. 15.

Referring to FIG. 18, the simple electrical schematic for the electric heating circuit includes the plug assembly 23 on one side thereof with the dual electric prongs 33-33, the circular electrical contact 35, and annular electrical contact 36 together with their respective contact members 42, 43, which are mounted in the plug assembly housing 37. At the opposing end of the two contacts in housing 37 are the extending contact arms 44, 45, respectively which engage the contact clip members 80, 81 only when the plug assembly is in its extended position. The contact clip members are connected through respective wiring to the pressure plates 94, 95 which when charged provide a voltage across the gap therebetween to heat the PTC element 91. While the material of which the PTC element is made provides a self-limiting device, this schematic also shows the insertion within semicircular contact plate 95, or by welding or the like, of a temperature cut-out device, or thermostat 97, which may be a bi-metallic strip type of contact. The thermostat provides an additional safety feature which breaks contact to open the circuit upon the attainment of a specified high temperature. When the device cools and the temperature drops below the specified temperature, the bi-metallic strip straightens and closes the circuit.

While one embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention.

We claim:

1. A hair curling appliance comprising in combination:

a hollow handle adapted to be conveniently grasped by the hand of a user;

an electrically heated curling wand including a heat retaining working portion therein, said wand being slidably mounted in said hollow portion of said handle for user operated movement between an exposed use position outwardly of said handle and an enclosed heating position inwardly of said handle thereof;

electric connection means movably mounted in said handle and movable between a first inoperative position retracted into said handle and a second operative position extended at least partially outwardly of said handle for conductively engaging a conventional wall socket, said connection means, when in said extended position, being in conductive operating connection with said working portion of said wand for supplying electric power thereto; and cooperative means associated with said connection means and wand and responsive to sliding movement of said wand in said handle for moving said electrical connection means to said extended position only when said wand is substantially inserted into said handle in said heating position.

2. The hair curling appliance as defined in claim 1 wherein said electrical connection means comprises:

a plug housing mounted for biased reciprocal movement along a pre-determined path of travel in the hollow portion of said handle;

a plug base rotatably mounted on said housing and including at least two conventional electrically conductive plug prongs extending therefrom, said plug housing being movable between a position wherein said prongs are substantially enclosed within said handle and a position wherein said prongs are substantially extended outwardly of said handle;

said plug housing and wand including cooperative separable means for transmitting electric current from said plug base to said wand working portion when said wand is in said position in said handle, and said rotatably mounted plug base including means for transmitting electric current from said prongs to said plug housing while permitting rotation of said plug base.

3. The hair curling appliance as defined in claim 2 wherein said means in said base and said housing for transmitting current includes at least one annular electric contact mounted in one of said base and said housing which is adapted for slidable engagement with a complementary electric contact mounted in the other of said housing and said base.

4. The hair curling appliance as defined in claim 2 wherein said means for transmitting electric current from said plug base to said wand working portion includes at least two contact arm members mounted on said housing, each adapted to engage a complementary contact on said wand working portion during a portion of the path of travel of said housing when said plug prongs are substantially fully extended outwardly of said handle.

5. The hair curling appliance as defined in claim 4 wherein the engagement between said contact arm members and said contacts is accomplished by a wiping action between the same for self-cleaning purposes in order to maintain electrical continuity therebetween.

6. The hair curling appliance as defined in claim 1 wherein said means responsive to sliding movement of said wand includes cam means positioned on an interior end of said curling wand; and cam follower means positioned on an interior end of said electrical connection means; whereby the insertion of said curling wand into the hollow interior of said handle causes the said cam means to engage said cam follower means and move said electrical connection means from said enclosed position inside said handle to said extended position.

7. The hair curling appliance as defined in claim 1 wherein said means responsive to sliding movement of said wand includes a lever arm pivotally mounted on the end of said wand positioned in said handle, said arm being pivoted in response to engagement with guide surface means extending inwardly of the hollow interior of said handle as said wand is slidably moved to its inwardmost slidable position in said handle, and said lever arm when pivoted engaging said electrical connection means for moving the same along a pre-determined path in said handle to said extended position.

8. The hair curling appliance as defined in claim 7 wherein said handle includes means defining a surface extending inwardly of the hollow interior thereof for locking said lever in fixed position; and wherein said lever arm is adapted to engage said locking surface as said electrical connection means reaches the end of said pre-determined path of travel outwardly of said handle.

9. The hair curling appliance as defined in claim 7 wherein means are provided in said handle for selectively disengaging said lever arm from said electrical connection means as said wand is slidably moved into the hollow portion of said handle.

10. In a hair curling appliance of the type including:

an elongate handle adapted for being grasped by a user of the appliance and including a hollow portion extending substantially axially therethrough;

an electrically heated curling wand including a heat retaining working portion, said wand being slidably extensibly mounted in said handle hollow portion for movement between an exposed use position outwardly of said handle and an enclosed heating position inwardly of said hollow portion of said handle; and an electric plug means slidably mounted in the hollow interior of said handle and adapted to be moved from a position enclosed within said handle to a position externally thereof for connection with a conventional electric wall socket, said plug means being conductively connected to the heating means of said wand working portion;

the improvement wherein cooperative means are provided on said wand and said plug means for moving, in response to sliding movement of said wand in said handle, said plug means to its external position only when said wand is in its enclosed heating position in said hollow portion of said handle.

11. The hair curling appliance as defined in claim 10 wherein said cooperative means includes a cam actuator positioned on an internal end of said wand; and a cam follower positioned on an internal end of said plug means adapted for engagement with said cam actuator; whereby the movement of said wand into the hollow portion of said handle acts through said cam actuator and cam follower to move said plug means from said enclosed position to said external position.

12. The hair curling appliance as defined in claim 10 wherein said plug means being also rotatably mounted on said handle for providing ease of connecting said appliance to a conventional wall socket.

13. The hair curling appliance as defined in claim 10 wherein a separable connection means is provided to conductively connect said plug means and said wand working portion only when said wand is substantially fully inserted in said hollow portion of said handle and said plug means is substantially fully extended from said handle.

14. The hair curling appliance as defined in claim 13 wherein the separable connection between said plug means and said wand working portion includes means providing a wiping action therebetween for cleaning said connection in order to maintain electrical continuity.

15. The hair curling appliance as defined in claim 10 wherein means is provided for selectively retaining said plug means in said handle when said wand is substantially fully inserted in said hollow portion of said handle.

16. A hair curling appliance comprising in combination:

an elongate handle of impact-resistant high-temperature plastic adapted for being conveniently grasped by a user, said handle including a pair of connected molded half-shell portions defining an exterior surface and a hollow interior space, said half-shell portions further defining an elongate top aperture, a circular bottom aperture, and a front aperture, a resiliently outwardly biased movable actuator being retained on said handle by the edge of said top aperture, the interior space of said handle including a first pair of opposed rectangular slots therein positioned substantially parallel to the longitudinal axis of said handle, and a second pair of opposed rectangular slots therein positioned substantially perpendicular to a plane defined by said circular bottom aperture, an electrically heated curling wand including a heat retaining working portion, said wand having an end slidably retained in said first pair of opposed slots for user operated movement outwardly and inwardly of said handle through said front aperture between an exposed use position outwardly of said handle and a heating position enclosed within said handle;

electrical connection means slidably retained in said second pair of slots in said handle and extensible therefrom through said circular aperture for conductively engaging a conventional wall socket, said connection means, when in extended position, being in conductive operating condition with said working portion of said wand; and cooperative means on said wand and said connection means and responsive to the slidable movement of said wand in said handle for moving said connection means to its extended position only when said wand is substantially fully inserted into its heating position within said handle.

17. The hair curling appliance as defined in claim 16 wherein said electrically heated working portion of said wand includes a tubular cover;

a positive temperature coefficient electric heating element positioned in said tubular cover;

a pair of electrically conductive plates positioned in spatial relation to each other on opposing sides of said element for providing a voltage thereacross when connected to a power source, said plates also providing a compressive force on said element when mounted in said tubular cover; and electrical insulation means positioned between said plates and said cover.

18. The hair curling appliance as defined in claim 16 wherein said electrical connection means includes a plug housing slidably mounted in said second pair of slots for biased reciprocal movement in said handle;

a plug base rotatably mounted on said housing including at least two conventional electric plug prongs extending therefrom;

said plug housing being movable between a position wherein said prongs are substantially extended outwardly of said handle and a position wherein said prongs are substantially enclosed within said handle;

said plug housing and said plug base having means thereon including at least one annular electric contact on one of said housing and said base for transmitting electric current from said prongs to said wand working portion while permitting rotation of said plug base.

19. The hair curling appliance as defined in claim 18 wherein said plug housing is resiliently biased inwardly of said handle in said second pair of opposed rectangular slots, the length of said second pair of slots being sufficient to maintain said plug prongs substantially inside said handle hollow interior portion, said prongs being movable to the exterior of said housing when said bias is overcome by said cooperative means.

20. The hair curling appliance as defined in claim 16 wherein said cooperative means on said wand and said electrical connection means includes a pair of lever arms pivotally mounted on the end of said wand retained in said first pair of slots, said arm being pivotable in response to engagement with guide surface means on the interior surface of said handle as said wand is slidably moved adjacent its inwardmost slidable position, and said lever arms when pivoted engaging said electrical connection means for moving the same along said second pair of slots to said extended position.

21. The hair curling appliance as defined in claim 20 wherein said handle interior space includes an inwardly extending wall adjacent the rear thereof; and wherein the distal ends of said lever arms are adapted to lockingly engage said wall as said electric connection means is moved to an external position of locking the same in said external position.

22. In a hair curling appliance of the type including an elongate handle adapted to be conveniently grasped by the hand of a user;

a curling wand extending from one end of said handle, said curling wand including a hollow thermally conductive cover and a cylindrical electric heater positioned therein, and means positioned in said handle in electrically insulative relation therewith for receiving and conducting electric current, said means being conductively connected with said electric heater;

the improvement wherein said electric heater includes a positive temperature co-efficient heating element, said heating element defining a disc having generally flat and spaced apart opposed parallel faces;

means including two electrically conductive plates positioned in spatial relation to each other and in electrical contact with said opposed parallel faces of said element for providing voltage thereacross when connected to a power source, said plates being electrically connected to said means for receiving and conducting electric current;

electrical insulation means positioned between said plates and said hollow cover; and at least two insulating members poistioned laterally of the opposite side edges of said element and parallel to said opposed parallel faces of said element and sandwiched between said conductive plates, and wherein said plates include bendable elongate tabular portions extending from opposed ends thereof for securing said plates to said insulating members.

23. In a hair curling appliance of the type including:

an elongate handle adapted for being grasped by a user and including a hollow portion positioned substantially axially therethrough;

a curling wand including a hollow tubular thermally conductive cover and a cylindrical electric heater positioned therein, said wand being slidably extensibly mounted in said handle hollow portion for movement through an opening in said handle from a first exposed working position outwardly of said handle and a second heating position enclosed within said handle portion; and an electric plug means slidably mounted in the hollow interior of said handle and adapted to be moved to a position externally thereof for connection of same with a conventional electric wall socket, said plug means being conductively connected to said electric heater of said wand working portion;

the improvement wherein said heater includes a positive temperature coefficient heating element, said heating element defining a disc having generally flat and spaced apart opposed parallel faces;

means including two electrically conductive plates positioned in spatial relation to each other and in electrical contact with said opposed parallel faces of said element for providing voltage thereacross when connected to a power source, said plates being electrically connected to said plug means;

electrical insulation means positioned between said plates and said hollow cover; and at least two insulating members positioned laterally of the opposite side edges of said element and parallel to said opposed parallel faces of said element and sandwiched between said conductive plates, and wherein said plates include bendable elongate tabular portions extending from opposed ends thereof for securing said plates to said insulating members.

* * * * *